US005877438A

United States Patent [19]

Lin

[11] Patent Number: 5,877,438

[45] Date of Patent: Mar. 2, 1999

[54] TRANSMISSION DEVICE TO PROVIDE RECIPROCATING AND RETURNING MOTION

[76] Inventor: Hsi-Chun Lin, P.O. Box 96-405, Taipei 10098, Taiwan

[21] Appl. No.: 797,234

[22] Filed: Feb. 7, 1997

[51] Int. Cl.[6] ..... G10F 1/06

[52] U.S. Cl. ..... 84/94.2; 84/95.2; 84/94.1; 84/94.2

[58] Field of Search ..... 84/95.1, 95.2, 84/94.1, 94.2; 40/455, 411; 446/298, 265

[56] References Cited

U.S. PATENT DOCUMENTS 5,430,239 7/1995 Chen ..... 84/95.2
5,459,278 10/1995 Hsu ..... 84/95.1

*Primary Examiner*—William M. Shoop, Jr.
*Assistant Examiner*—Kim Lockeh
*Attorney, Agent, or Firm*—Bacon & Thomas, PLLC

[57] ABSTRACT

A transmission device to provide reciprocating and returning motion, which comprises a music box, a doll, and a motion assembly with a rotative shaft; the doll is mounted on the rotative shaft; the lower end of the rotative shaft is furnished with a rotative gear to be engaged with a driven gear, which has a shaft hole to be mounted with a rotative shaft of a driving gear; the driven gear has a curved guide groove for receiving short shaft of the driving gear, which is engaged with a gear rack of a guide plate. When the motion assembly is pulled with a pull plate to move along the guide plate, the driving gear will be driven to turn with the gear rack of the guide plate; then, the driving gear will be driven to turn with the gear rack of the guide plate; simultaneously, the short shaft of the driving gear will move along the guide groove of the driven gear, and then the doll on the rotative shaft will move straight as a result of the motion assembly moving. After the short shaft of the driving gear reaches one end of the guide groove, the driven gear will turn at a given angle to drive the rotative gear under the doll to turn so as to have the doll returned at an angle of 180 degrees, and the doll will always face in a direction same as that of the motion thereof.

5 Claims, 7 Drawing Sheets

TRANSMISSION DEVICE TO PROVIDE RECIPROCATING AND RETURNING MOTION

BACKGROUND OF THE INVENTION

1. Field of the Invention

This invention relates to a music box, and particularly to a music box, having a transmission device, which can drive a doll mounted thereon to move back and forth, and to return.

2. Description of the Prior Art

In the conventional music box, the music drum has a shaft mounted with a transmission gear, which engages with a plurality of gear trains; each gear train is connected with a transmission structure to actuate a doll mounted on the music box to have a simple rotation, a left-and right swinging, an up-and-down motion, an up-and-down swinging, and a reciprocating motion; the aforesaid motions are usually done by means of structures as follows:

For rotation: A structure may include a rotative gear and a rotative shaft, which extends upwards, being mounted with a doll.

For swinging laterally: A structure includes a rotative gear and a swinging arm, which are coupled together by using a connecting rod; when the rotative gear turns, the swinging arm will be pulled to move back and forth, and therefore a doll mounted on a shaft furnished on the swinging arm will swing laterally.

To move up and down: A structure may include an eccentric wheel to pull two guide members to move up and down; the guide member has shaft extended over the music box to be mounted with a doll; when the eccentric wheel actuates the two guide members to move up and down, the doll will also move up and down.

To swing up and down: A structure similar to a rocking chair includes a gear with a short shaft or an eccentric wheel, which is connected with a vertical swinging rod; when the gear rotates, the short shaft on the gear will drive the swinging rod, and then the doll over the music box will swing.

To reciprocate: A structure includes a guide member fixedly mounted to a rail; the guide member is connected with a rotative gear via a connecting rod; when the rotative gear turns, the guide member will move back and forth.

SUMMARY OF THE INVENTION:

The prime object of the present invention is to provide a transmission device, in which a doll over the music box can, upon a motion assembly moving, move back and forth, and can return after reaching one end; the moving doll can always face in a direction same as that of the motion thereof.

Another object of the present invention is to provide a transmission device, in which the doll over the music box is connected with a rotative shaft, which is coupled with a rotative gear of the motion assembly. The rotative gear is coupled with a driving gear through a driven gear; the driving gear engages with a gear rack of a guide plate. The aforesaid gears are mounted between an upper base and a lower base of the motion assembly. The bottom of the motion assembly has a pull plate connected with a displacing element; when the motion assembly is pulled with the pull plate to move, the motion assembly will move along the guide plate to actuate the doll over the music box to move back and forth with the face thereof facing in a direction same as that of the motion thereof.

Still another object of the present invention is to provide a transmission device, in which both the upper case and the lower case are furnished with several gear sockets respectively for receiving the several rotative gears respectively. Beside the gear socket of the driving gear, there is a guide channel for receiving the guide plate. when the motion assembly is pulled with the pull plate, the driving gear will move along the guide plate. The driving gear has a short shaft engaged in a guide groove in the driven gear. When the short shaft moves in the guide groove, the doll on the rotative shaft will move as a result of the motion assembly; as soon as the short shaft of the driving gear reaches one end of the guide groove, the driven gear will be pushed to move and to cause the rotative gear to rotate so as to have the doll on the rotative shaft returned at an angle of 180 degrees before reaching the end, and the doll will face in a direction same as that of the motion thereof.

DETAILED DESCRIPTION OF THE PREFERRED EMBODIMENT

Figure 1:
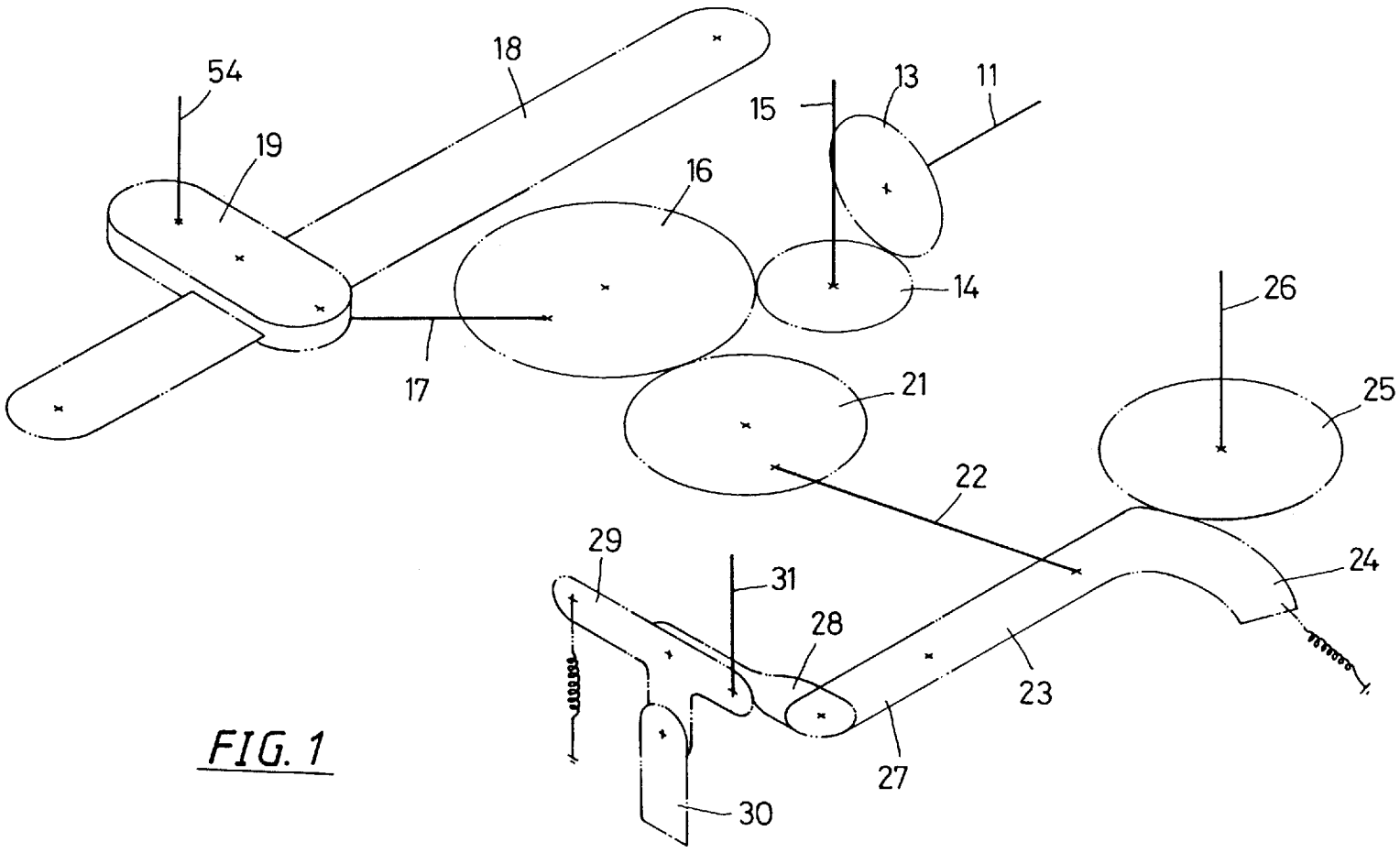
FIG. 1 is a schematic diagram of the present invention, showing the structure of a music box thereof.
Figure 2:
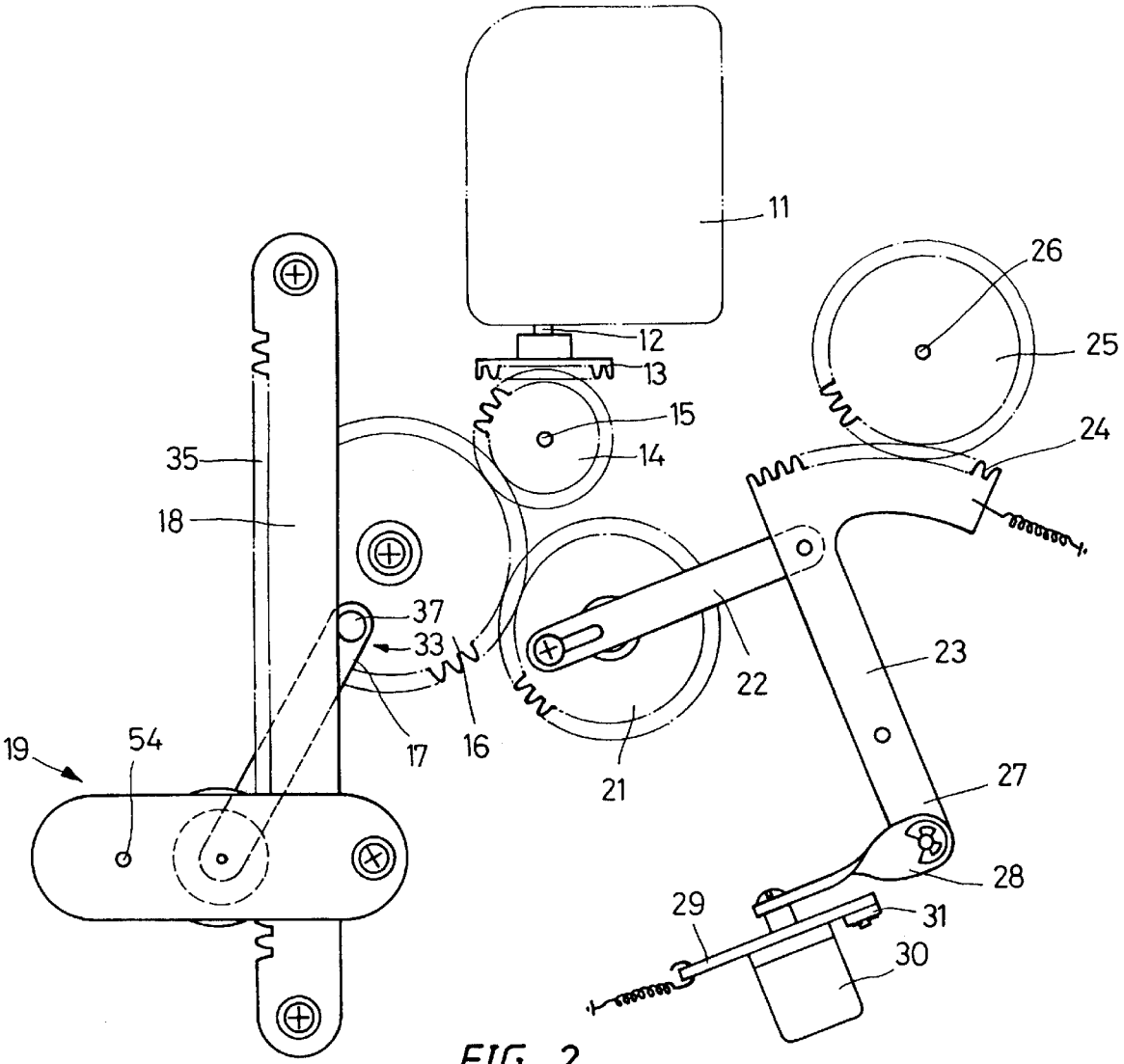
FIG. 2 is a plan view of the present invention, showing the structure of the music box thereof.
Figure 3:
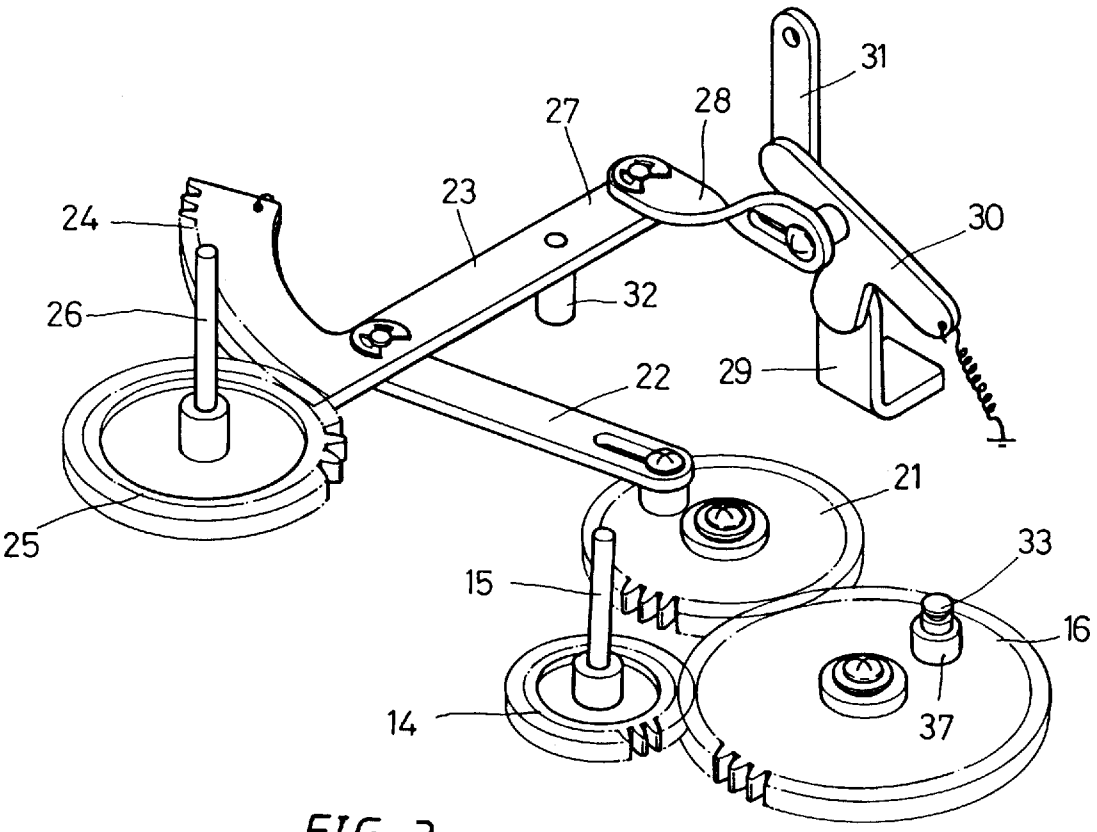
FIG. 3 is a perspective view of the present invention, showing a fragmental transmission structure of the music box.

Referring to FIGS. 1 to 3, this invention relates to a transmission structure of music box, which comprises a dynamic source 11 with a transmission shaft 12 connected with a rotative gear 13; the rotative gear 13 is used for transmitting a force to a rotation assembly, and a reciprocating and returning assembly so as to provide a doll on the music box with various motions, such as rotating, swinging to generate more, fun from the doll on the music box.

The transmission structure of the music box is mounted on a base; a rotative gear 13 mounted on a transmission shaft 12 is engaged with a rotative gear 14, of which the center has a rotative shaft 15 extended upwards and connected with a doll; the doll will turn upon the rotative gear 14 turning. The rotative gear 14 also transmits a dynamic force to a swinging gear rack 24 through two transmission gears 16 and 21, a connecting rod 22 and a swinging rod 23; the swinging gear rack 24 is engaged with a swinging gear 25 so as to have a doll on a swinging shaft 26 swung leftwards and rightwards. The dynamic force is also transmitted to a connecting rod 28 mounted on an arm plate 27 on the other end of the swinging rod 23 so as to have a doll mounted on the swinging assembly moved up and down.

Referring to FIGS. 2 to 5, the pull plate transmission gear 16 has a shaft socket 37 on the surface thereof, and a connecting shaft 33 is mounted therein; the connecting shaft 33 is pivotally connected with a connecting element which may be one end of a pull plate 17, of which the other end is connected with a short connecting shaft 34 of a motion assembly 19. The shaft socket 37 can move circularly only when the pull plate transmission gear 16 rotating, and then it will pull the pull plate 17 to cause the motion assembly 19 to move back and forth along a guide plate 18; the guide plate 18 is fastened on a base of the music box; the guide plate 18 has a substantially rectangular section, a guide surface 36 on one side and a gear rack 35 on the other side thereof. The guide plate 18 is mounted in a guide channel 44 in the lower base 42 of the motion assembly 19. The gear rack 35 of the guide plate 18 is engaged with a driving gear 50 mounted in a driving gear socket 48 in the lower base 42; when the motion assembly 19 moves back and forth along the guide plate 18, the driving gear 50 will be driven by the motion assembly 19 to rotate along the gear rack 35 of the guide plate 18.

Between the upper base 41 and the lower base 42 of the motion assembly 19, there are several gear sockets 59, 58 and 48 for receiving a rotative gear 53, a driven gear 51 and the driving gear 50. The rotative gear 53 is mounted in rotative gear socket 59 in the upper base 41, and the top side thereof has a rotative shaft having a suitable length extended through a rotative shaft hole 65 in the upper base 41 and to the outside of the music box; the end of the rotative shaft 54 is connected with a doll. The lower shaft end of the rotative gear 53 is pivotally fitted into a shaft hole 38 in the lower base 42, and the surface of the gear is close to the flat surface of the lower base 42; driven gear socket 58 is used for mounting driven gear 51, of which the center has a shaft through hole 62 for receiving a rotative shaft 57 of the driving gear 50; one end of the driven rotative shaft 57 is fitted into a rotative shaft hole 64 of the gear socket 58, and is used as a supporting shaft for the driven gear 51. The gear sockets 58 and 59 in the upper base 41 are arranged in a tangential manner for receiving the driven gear 51 and the rotative gear 53 respectively; the two gears 51 and 53 are engaged with each other on the tangential side thereof. The outer circle of the shaft through hole 62 on the driven gear 51 has a curved guide groove 56 for receiving a short shaft 52 of the driving gear 50, which is mounted in the gear driving socket 48 in the lower base 42, while the shaft thereof is mounted in a driving shaft hole 63 in the driving gear socket 48; the driving gear socket 48 and the guide channel 44 are designed in tangential manner; the driving gear 50 and the guide plate 18 are engaged with each other on the gear rack 35 thereof. The driving gear 50 has a rotative shaft 57 in the center thereof and a short shaft 52 beside the rotative shaft 57. After the rotative shaft 57 passes through the shaft through hole 62 to insert in the rotative shaft hole 64 of the gear driven socket 58, the short shaft 52 will be engaged in the guide groove 56 of the driven gear 51.

Figure 4:
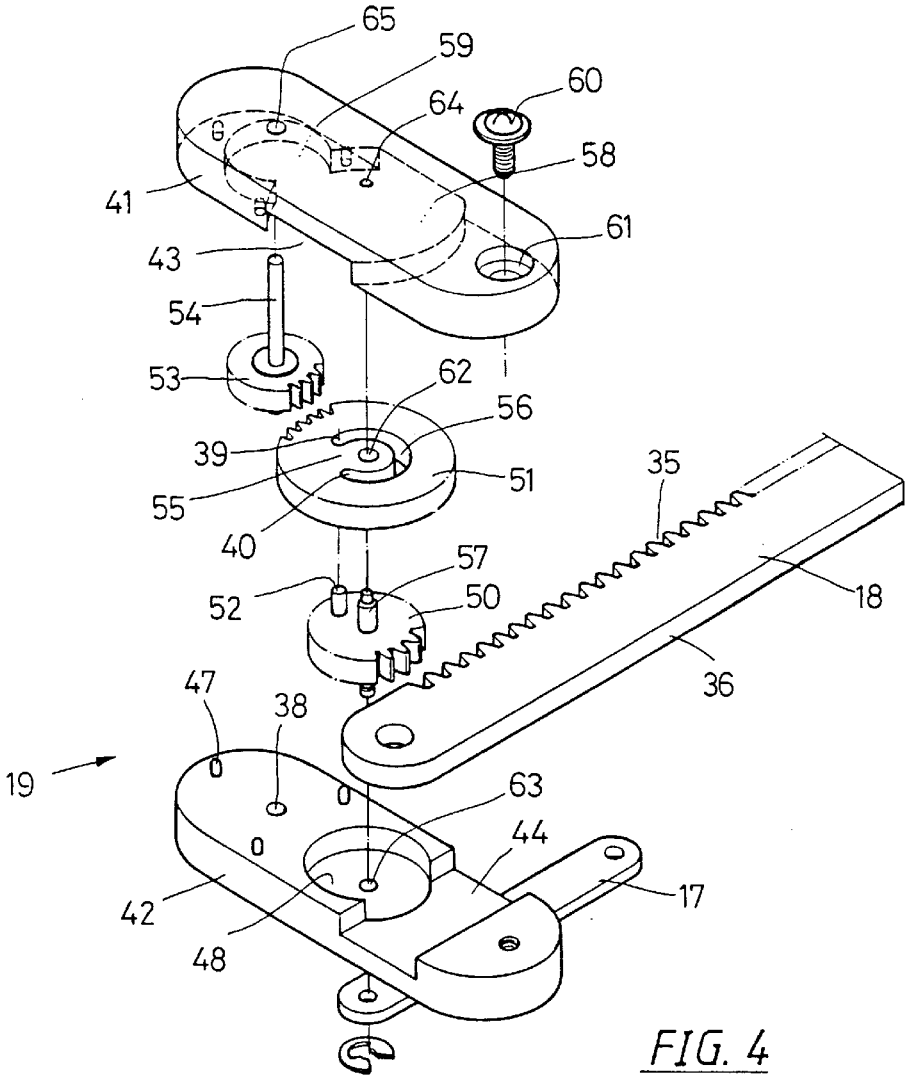
FIG. 4 is exploded view of the present invention, showing the structure of the motion assembly thereof.
Figure 5:
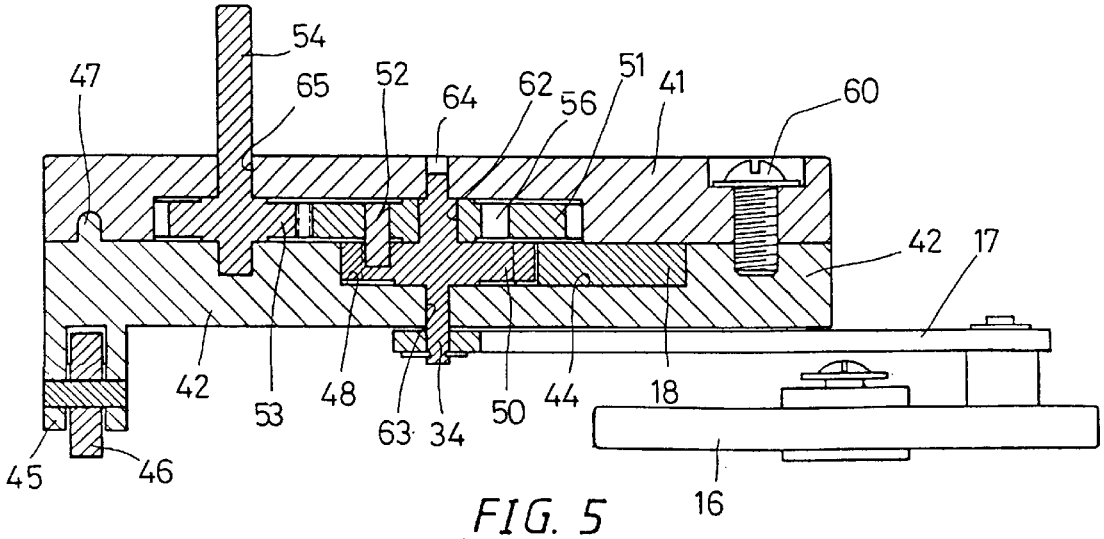
FIG. 5 is a sectional view of the present invention, showing assembled structure of the motion assembly thereof.

Referring to FIGS. 4 and 5, the gear sockets 59, 58 and 48 between the upper base 41 and the lower base 42 of the motion assembly 19 are used for mounting the rotative gear 53, the driven gear 51 and the driving gear 50, respectively. The upper base 41 and the lower base 42 are assembled together by a plurality of positioning pins 47 and a screw 60. The bottom of the lower base 42 mounted with a short connecting shaft 34 to be connected with one end of the pull plate 17; the short connecting shaft 34 may be substantially an extended part of the driving shaft of the driving driving gear 50 to pass through the shaft hole 63 of the gear socket 48 and to extend out of the lower base 42. The short connecting shaft 34 may be a separate shaft furnished under the lower base 42. The outer edge of the lower base 42 has a wheel seat 45 for mounting a wheel 46, of which the surface is in close contact with the surface of the music box, and the wheel 46 is used as a balance support to the motion assembly 19 upon moving.

Figure 6:
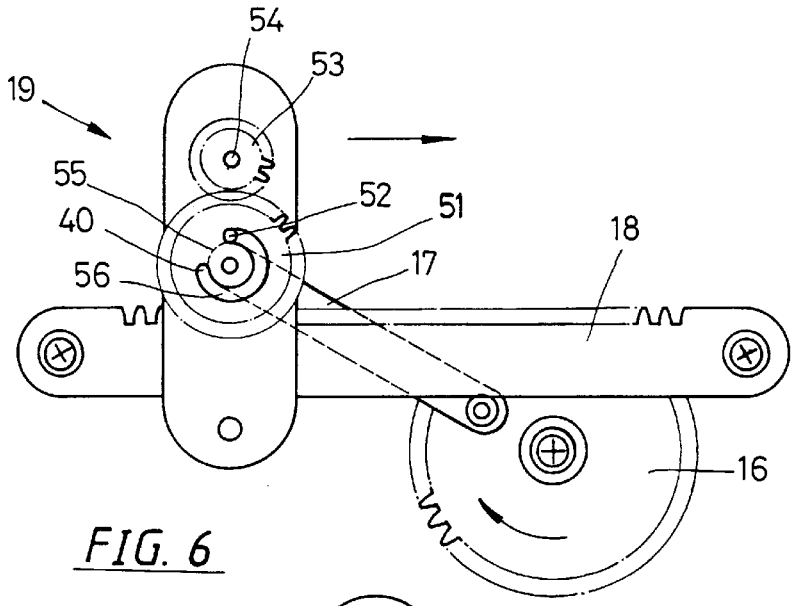
FIG. 6 is a plan view of the present invention, showing the rotative shaft moving in one direction together with the motion assembly thereof.
Figure 7:
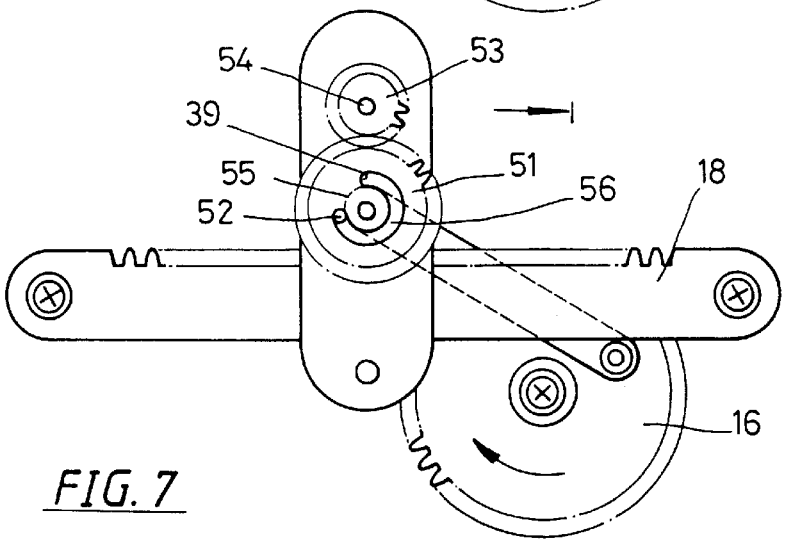
FIG. 7 is a plan view of the present invention, showing the rotative shaft at a position before returning.

Referring to FIGS. 4 to 7, when the pull plate transmission gear 16 rotates, the connecting shaft 33 in the shaft socket 37 will move circularly to cause the pull plate 17 to pull the motion assembly 19 to move back and forth along the guide plate 18. In order to simplify the description, a doll on the rotative shaft 54 of the motion assembly 19 is supposed to move leftwards (as shown with the arrow), and it is supposed to be a starting point of the transmission structure (as shown in FIG. 6). The short shaft 52 on the driving gear 50 is fitted in one groove end 39 of the guide groove 56 of the driven gear 51. The motion assembly 19 is pulled with the pull plate 17 to move along the guide plate 18, and the driving gear 50 in the driving gear socket 48 of the lower base 42 is engaged with the guide plate 18 in the guide channel 44; the driving gear 50 will follow the motion assembly 19 to move along the guide plate 18, and the short shaft 52 on the driving gear 50 will also move along the guide groove 56 of the driven gear 51. The rotative gear 53 under the rotative shaft is not driven, and the therefore the doll mounted on the rotative shaft 54 can only move straight until the short shaft 52 on the driving gear 50 moving to the groove end 40 of the guide groove 56 (as shown in FIG. 7).

There is a stop part 55 furnished between the two groove ends 39 and 40 of the curved guide groove 56; the short shaft 52 mounted in the guide groove 56 is to be moved along the guide groove 56 upon the driven gear 51 moving. Before the short shaft 52 reaches one of the groove ends 39 and 40, the driven gear 51 is remaining in still state; as soon as the short shaft 52 touches the stop part 55, the driven gear 51 will be pushed to rotate; simultaneously, the rotative gear 53 will be driven to move. In order to have the doll on the rotative shaft 54 on the rotative gear 53 turned at an angle of 180 degrees, the number of teeth furnished on the driven gear 51 and the driving gear 50 should be pre-designed properly so as to have the short shaft 52 reached the groove end exactly; further, the diameter and the number of teeth on the rotative gear 53 should also be well designed so as to have the number of teeth of the driven gear 51 exactly driven the doll on the rotative shaft 54 on the rotative gear 53 to turn at an angle of 180 degrees.

Figure 8:
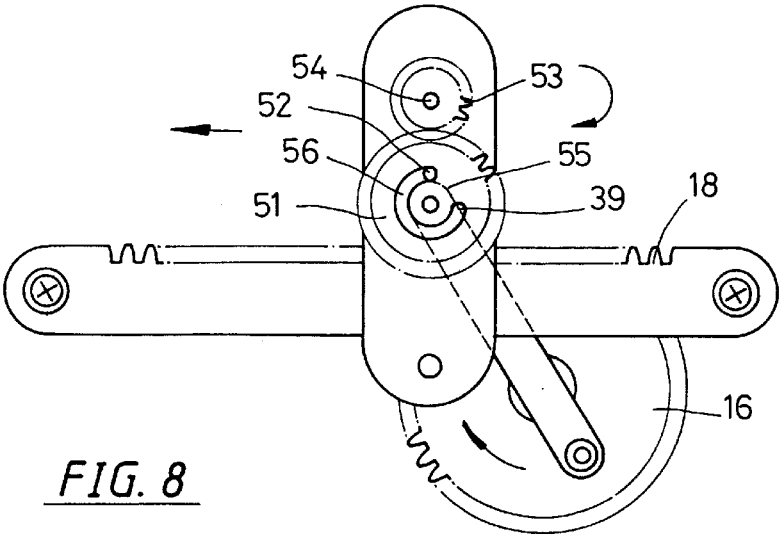
FIG. 8 is a plan view of the present invention, showing the rotative shaft at a position after returning.

Referring to FIGS. 4, 7 and 8, the driven gear 51 has shaft through hole 62, through which the driven gear 51 is mounted on the rotative shaft 57 of the driving gear 50, while the edge of the driven gear is engaged with the rotative gear 53. When the motion assembly 19 is pulled to a position (during moving) as shown in FIG. 7, the short shaft 52 on the driving gear 50 has moved and reached another groove end 40 of the guide groove 56, but the driving gear 50 still continues to move until the short shaft 52 being stopped at the stop part 55, and then the driven gear 51 is applied with a dynamic force, and starts to move from that point (as shown in FIG. 7). The driving gear 50 continues to turn, and the short shaft 52 will drive the driven gear 51 to turn; then, the rotative gear 53 engaged with the driven gear 51 will be driven to turn; the doll on the rotative shaft 54 will continue to move until the short shaft 52 of the driving gear 50 driving the driven gear 51 to a position as shown in FIG. 8; in that case, the shaft socket 37 of the pull plate transmission gear 16 has pulled the motion assembly 19 to an end, i.e., the motion assembly 19 being unable to move further; simultaneously, the doll on the rotative shaft 54 has turned at an angle of 180 degrees, i.e., reaching a point to change the moving direction; at the same time, pull plate transmission gear 16 continues to turn so as to push the motion assembly 19 to move back along the guide plate 18.

Figure 9:
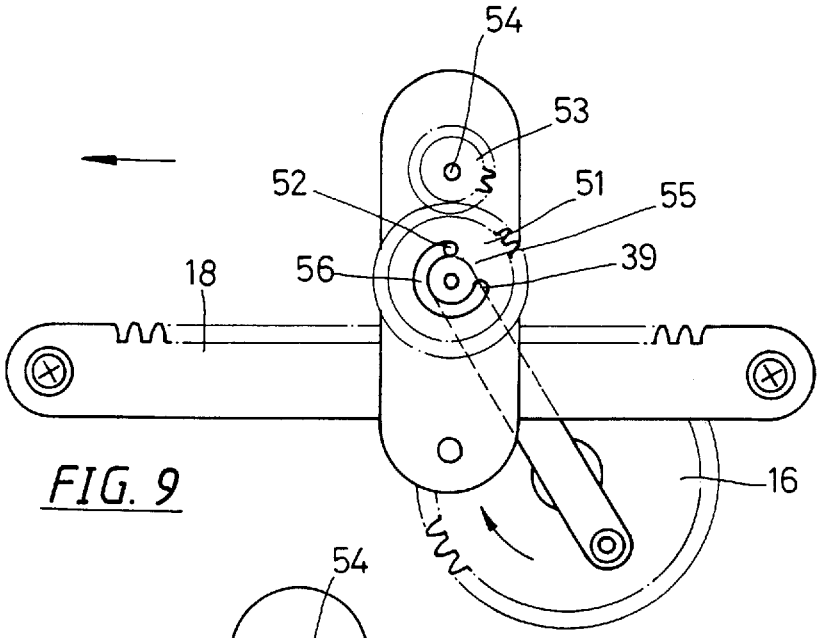
FIG. 9 is a plan view of the present invention, showing the rotative shaft at a starting point to move straight after rotating.
Figure 10:
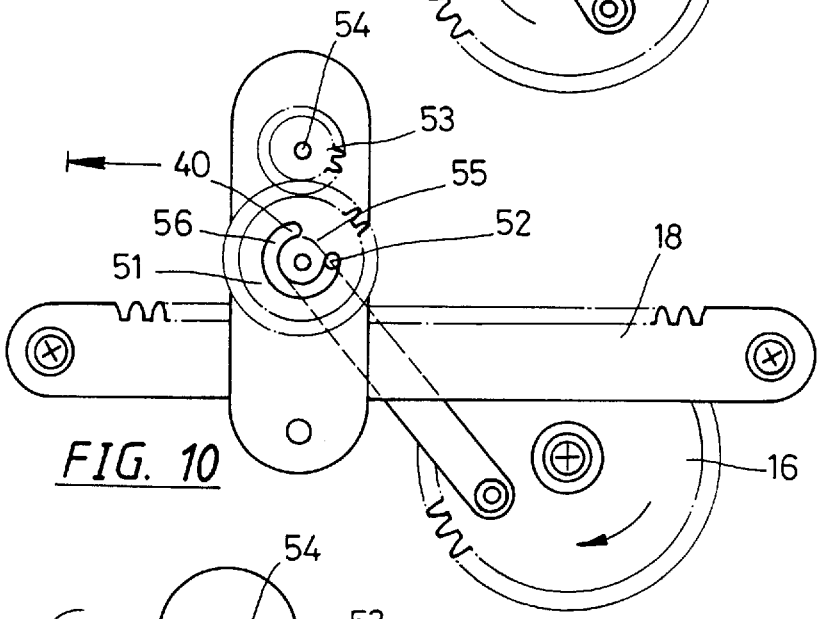
FIG. 10 is a plan view of the present invention, showing the rotative shaft at the ending point of a straight line after returning.

Referring to FIGS. 4, 9 and 10, after the motion assembly 19 is pulled to one end, the doll has rotated at an angle of 180 degrees, and then it faces in right direction (as shown with the arrow); when the motion assembly 19 is pulled with the pull plate 17 to move back along the guide plate 18, the driving gear 50 will rotate counter-clockwise; then, the short shaft 52 on the driving gear 50 will move along the guide groove 56 of the driven gear 51; the short shaft 52 will move from the groove end 40 towards the groove end 39; the motion assembly 19 will move from the position as shown in FIG. 9 to that as shown in FIG. 10. When the short shaft 52 on the driving gear 50 moves along the guide groove 56 of the driven gear 51, the driven gear 51 does not drive the rotative gear 53 to turn, while the doll on the rotative shaft 54 moves straight until the short shaft 52 reaching the groove end 39, and then the driven gear 51 will be pushed to turn.

Figure 11:
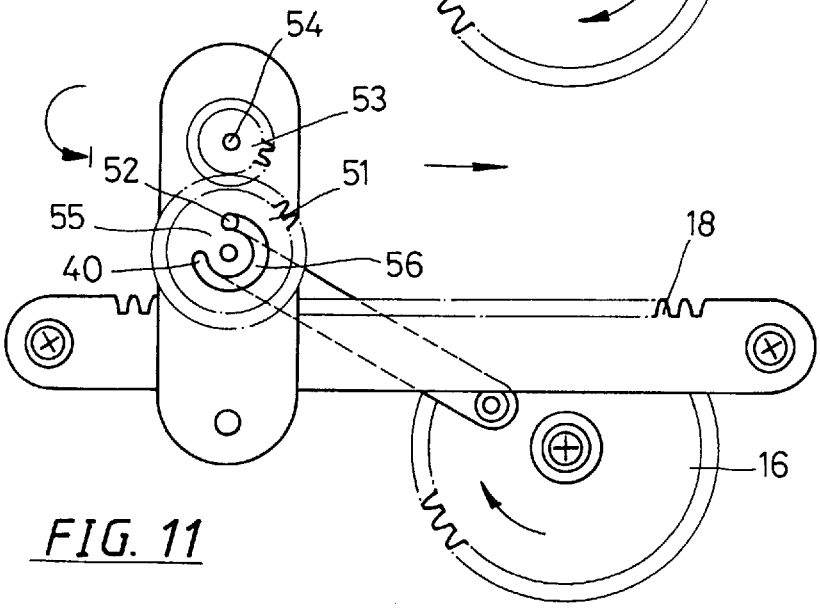
FIG. 11 is a plan view of the present invention, showing the rotative shaft at a position after second returning.

Referring to FIGS. 4, 10 and 11, the short shaft 52 of the driving gear 50 has moved to the groove end 39 of the guide groove 56 (as shown in FIG. 10), and then the short shaft 52 will push the driven gear 51 to turn; simultaneously, the rotative gear 53 will be driven to turn again; the doll on the rotative gear 54 will turn at an angle of 180 degrees again (as shown in FIG. 11), and it will again return to the position as shown in FIG. 6, continuing to move straight and to return, to move straight and to return repeatedly; when the doll on the rotative shaft 54 moves, the doll will face the direction same as that of the motion thereof.

Figure 12:
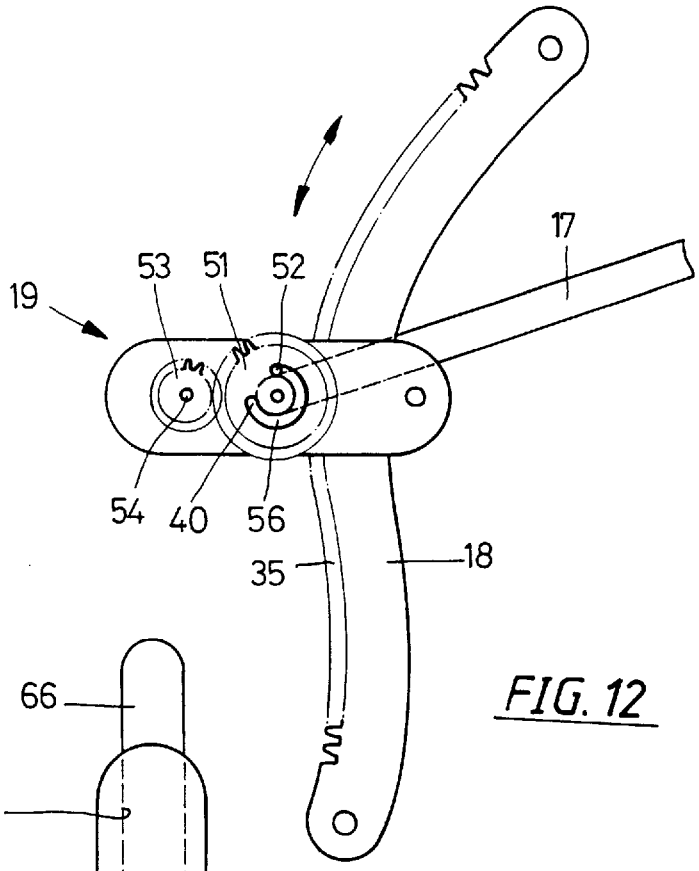
FIG. 12 is a plan view of an embodiment of the guide plate according to the present invention.

Referring to FIG. 12 again, the guide plate 18 to guide the motion assembly 19 may be a straight one or a curved one to have the motion assembly 19 to move along the same so as to cause the doll to move along a straight or curved path back and forth.

Figure 13:
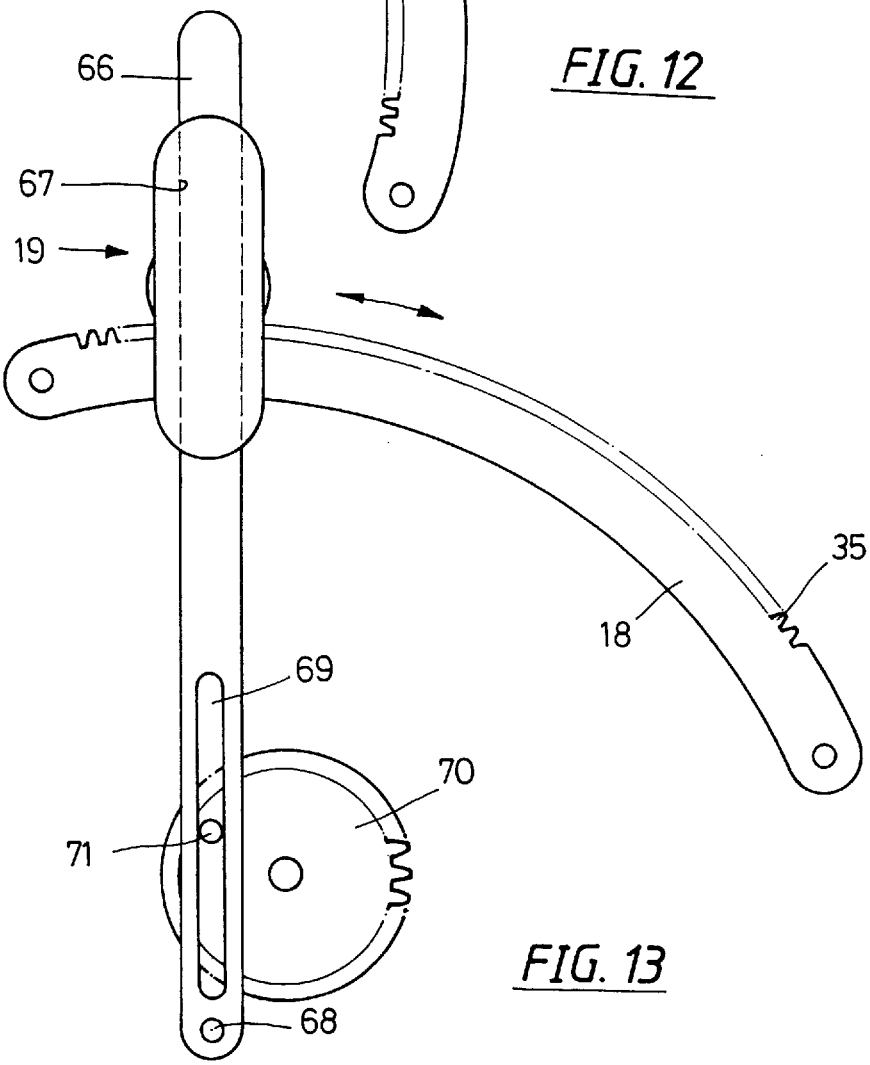
FIG. 13 is a plan view of an embodiment of the motion assembly according to the present invention, being driven to move.

Referring to FIG. 13 again, the guide plate 18 is a curved plate. The bottom side of the motion assembly 19 has a pull plate guide channel 67; the pull plate 17 in the previous structure is designed and used as a swinging pull plate 66 mounted in the pull plate guide channel 67 under the motion assembly 19; the other end of the swinging pull plate 66 is connected to the base by pull plate shaft 68; the same end of the swinging pull plate 66 is furnished with a guide slot 69 engaged with a guide shaft 71 of a pull plate driving gear 70. When the driving gear 70 is driven to turn, the guide shaft 71 on the pull plate driving gear 70 will move circularly to pull the swinging pull plate 66 to swing; then, the gears in the motion assembly 19 will, upon the motion assembly 19 moving, guide the doll over the music box to move straight and to return, to move straight and to return, repeatedly.

The present invention has been described with the aforesaid embodiment to point out the features and structure thereof. It is apparent that the present invention has been improved, and is not anticipated by any person skilled in the art; the structure of the present invention is deemed unique.

I claim:

1. A music box having a transmission device transmission device for providing reciprocating and returning motion, comprising:

a motion assembly having an upper base and a lower base, said lower base having a guide channel and a driving gear socket disposed on a top side thereof, said driving gear socket including a driving shaft hole, said upper base having a driven gear socket and a rotative gear socket disposed on a bottom side thereof, said driven gear socket and said rotative gear socket including a first rotative shaft hole and a second rotative shaft hole, respectively;

said motion assembly further including a driving gear, a driven gear and a rotative gear, said driving gear including a first rotative shaft and a short shaft on an upper side thereof and a driving shaft on a lower side thereof, said driving gear being mounted in said driving gear socket with said driving shaft pivotally mounted in said driving shaft hole, said driven gear including a shaft through hole and a guide groove, said driven gear being mounted in said driven gear socket and pivotally mounted on said first rotative shaft via said shaft through hole with said short shaft engaged in said guide groove, said first rotative shaft being pivotally mounted in said first rotative shaft hole, said rotative gear including a second rotative shaft, said rotative gear being mounted in said rotative gear socket with said second rotative shaft passing through said second rotative shaft hole, said second rotative shaft having a suitable length to extend above a music box to be connected with a doll, said rotative gear being engaged with said driven gear;

a substantially elongate and rectangular guide plate mounted in said guide channel of said motion assembly, said guide plate having a guide surface on one side and a gear rack on the other side, said gear rack being engage with said driving gear, said guide plate having both ends thereof mounted to a base of said music box; and a pull plate having two ends, said pull plate being connected at one of said two ends with said motion assembly via a connecting element mounted under said lower base and connected at the other of said two ends with an element for pulling said motion assembly.

2. A transmission device according to claim 1, wherein said connecting element mounted under said lower base is a short connecting shaft connected to said one end of said pull plate; and wherein said element for pulling said motion assembly is a pull plate transmission gear, said pull plate transmission gear having a shaft socket thereon with which said other end of said pull plate is connected, said pull plate transmission gear being arranged to move circularly to pull said pull plate so that said motion assembly is pulled into motion.

3. A transmission device according to claim 1, wherein said connecting element mounted under said lower base is a pull plate guide channel for receiving said pull plate;

wherein said pull plate is a swinging pull plate which is connected at one of said two ends with said motion assembly via said pull plate guide channel and is pivotally connected at the other of said two ends to said base of said music box by a pull plate shaft, said swinging pull plate having a guide slot near said pull plate shaft; and wherein said element for pulling said motion assembly is a pull plate driving gear, said pull plate driving gear having a guide shaft thereon which is received in said guide slot, said pull plate driving gear being arranged to move circularly to pull said swinging pull plate via said guide shaft so that said motion assembly is pulled into motion.

4. A transmission device according to claim 1, wherein said guide plate mounted in said guide channel of said motion assembly is a straight plate and said gear rack of said guide plate is a straight gear rack, whereby said motion assembly is guided to move along a straight path.

5. A transmission device according to claim 1, wherein said guide plate mounted in said guide channel of said motion assembly is a curved plate and said gear rack of said guide plate is a curved gear rack, whereby said motion assembly is guided to move along a curved path.

* * * * *